US005845378A

United States Patent [19]

Karmeli et al.

[11] Patent Number: 5,845,378

[45] Date of Patent: Dec. 8, 1998

[54] CLASP FOR EARRING POST

[76] Inventors: David D. Karmeli, 181 Madison Ave., New York, N.Y. 10016; Luca Lauritano, 60/35-36 Sol 11, Navanakom Industrial Estate, Phahonyothin Avenue, Klong Luang 1, Patumthani 12130, Thailand

[21] Appl. No.: 990,628

[22] Filed: Dec. 15, 1997

[51] Int. Cl.[6] ..... A44C 7/00

[52] U.S. Cl. ..... 24/705; 63/12

[58] Field of Search ..... 63/12, 13; 24/705, 24/706.9, 707.5, 707.2, 671

[56] References Cited

U.S. PATENT DOCUMENTS

| | | | |
|---|---|---|---|
| 1,358,465 | 11/1920 | Reston | 24/707.5 X |
| 1,433,790 | 10/1922 | Carr | 24/671 |
| 4,630,452 | 12/1986 | Connelly et al. | 24/705 X |
| 4,686,837 | 8/1987 | Carre | 24/705 |

FOREIGN PATENT DOCUMENTS

| | | | |
|---|---|---|---|
| 41781 | 4/1933 | France | 63/12 |
| 3002522 | 7/1981 | Germany | 63/12 |
| 557571 | 2/1957 | Italy | 63/12 |

*Primary Examiner*—James R. Brittain
*Attorney, Agent, or Firm*—Notaro & Michalos P.C.

[57] ABSTRACT

A clasp for the post of an earring has a c-shaped resilient pincer disk which engages onto the post. A washer with a hole therethrough is stacked with the pincer disk and both the disk and washer are held within a resilient elastic holder.

9 Claims, 4 Drawing Sheets

CLASP FOR EARRING POST

FIELD AND BACKGROUND OF THE INVENTION

The present invention relates in general to a new and useful clasp for the post of an earring for pierced ears.

It is known to provide a post for ornaments to be worn on the ears as earrings, which are straight and extend through a hole in the ear. It is also known to hold the post on the ear by placing a clasp, clutch or clamp onto the end of the post.

FIG. 5 illustrates one conventional clasp 100 for a post 110 of an earring. Clasp 100 includes a disk-shaped base 112 to which is connected, for example by soldering, a curved double-armed loop of springy metal 114 which has arms that engage on opposite sides of the end of the post 110.

FIG. 6 illustrates another known clasp which has a disk 116 with a hole therethrough for receiving the post 110, and a pair of spring-loaded pushbuttons 118 to engage and release the post.

FIG. 7 shows another conventional design which utilizes a bulbous catch 120 which has an opening therethrough and internal compression parts which squeeze against the post 110 to hold clasp 120 on the post.

A need remains for an inexpensive and effective earring post clasp.

SUMMARY OF THE INVENTION

The present invention is a clasp which is made of a single flat disk of material in its simplest form, defining pincers which can engage onto the outer surface of an earring post.

In a more complex form of the invention, the pincer disk is engaged with a washer and both are held within a resilient plastic housing for cooperation with each other and for engagement onto the post. The plastic housing serves the additional purpose of protecting the back of the ear from the metal parts of the clasp.

Accordingly, an object of the present invention is to provide an earring post clasp which comprises a pincer disk made of resilient material, preferably metal, and having an opening dividing the disk into a pair of pincer arms which are connected to each other by a resilient bridge. Each of the arms carries a pincer surface with the opposite pincer surfaces engaged on opposite sides of the post to resiliently hold the disk onto the post.

A further object of the present invention is to combine the pincer disk with a washer having an opening therethrough which is larger than the diameter of the post and which, with the disk, is resiliently held within an elastic synthetic holder made of any appropriate synthetic material such as polyethylene, vinyl, nylon or other elastic polymer. The holder may be cloudy or clear and white or of any color.

A still further object of the present invention is to provide an earring post clasp which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
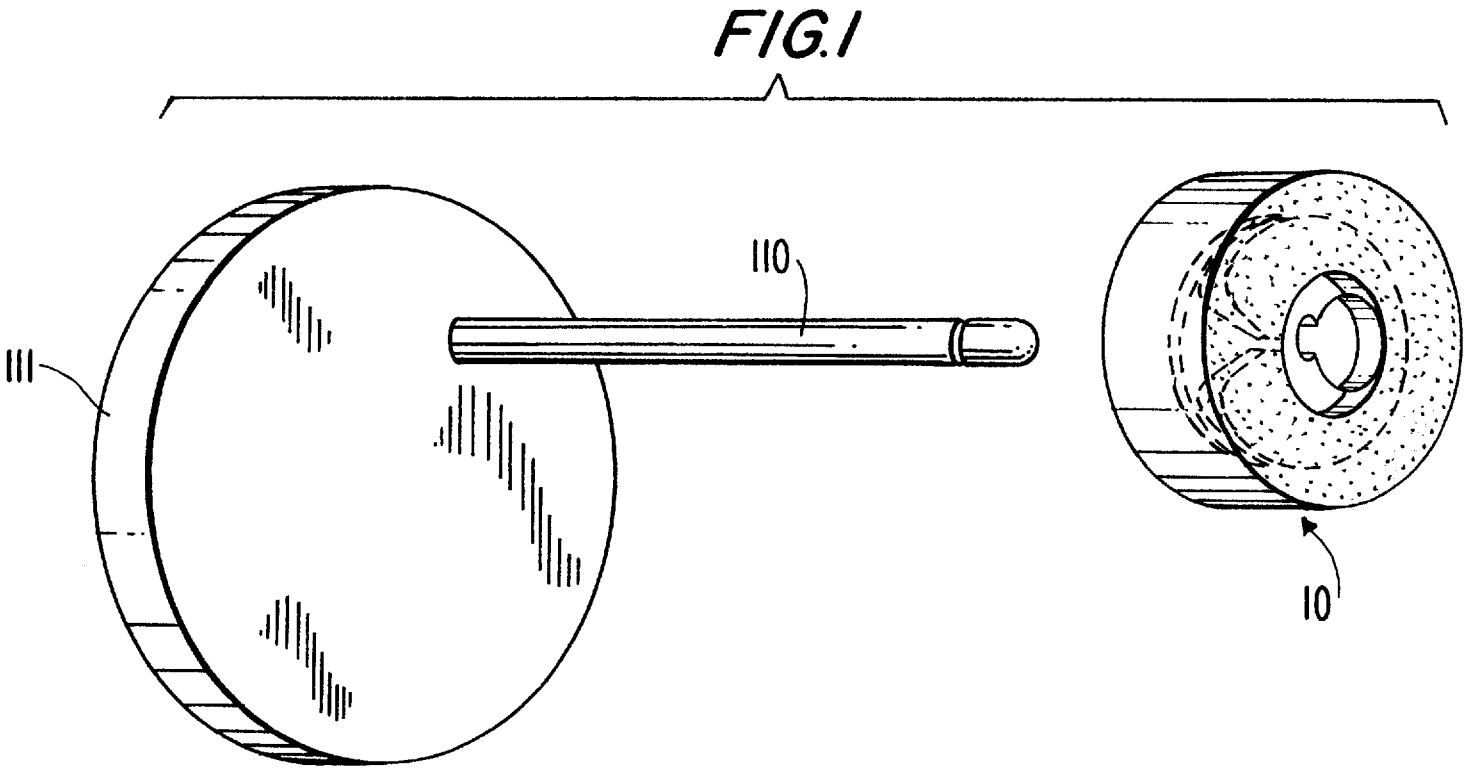
FIG. 1 is an exploded view of an earring with post and clasp according to the present invention.
Figure 3:
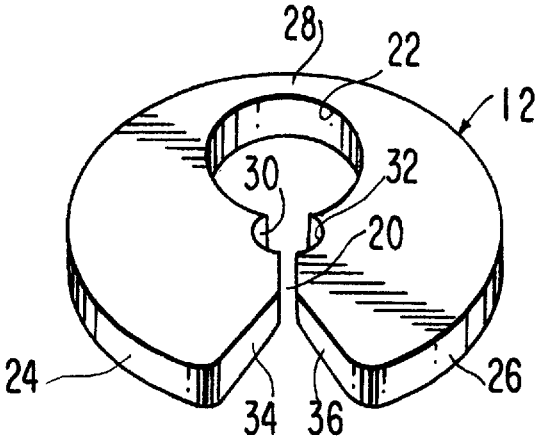
FIG. 3 is a perspective view of a pincer disk which itself can form a simplified version of the present invention.
Figure 2:
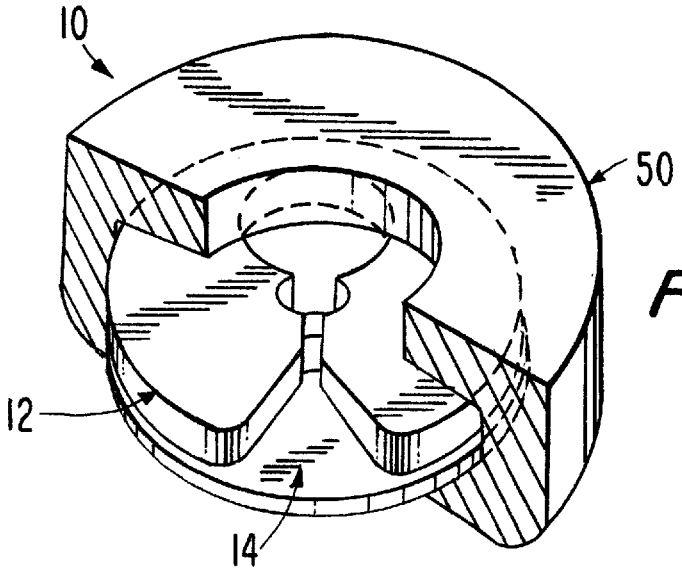
FIG. 2 is a perspective view, partly in section, of a clasp assembly according to the present invention.

Referring in particular to FIGS. 1 through 4, the preferred embodiment of the present invention is a clasp generally designated 10 in FIGS. 1 and 2 which is meant to engage and resiliently hold post 110 of an earring 111. Clasp 10 comprises a pincer disk 12 which is stacked above a washer 14. Both held within an elastic cylindrical holder 16. Only half of the holder is shown in FIG. 2 so that the relative positions of the disk and washer are clearly visible. As shown in FIG. 3, pincer disk 12 contains a large, generally circular or oval opening 22 which divides disk 12 into a pair of arms 24 and 26 which are connected to each other by a resilient bridge 28. Disk 12 is made of resilient material and although plastic may be used, the preferred material is metal, in particular stainless steel, silver, gold or other metal that has resiliency.

Figure 10:
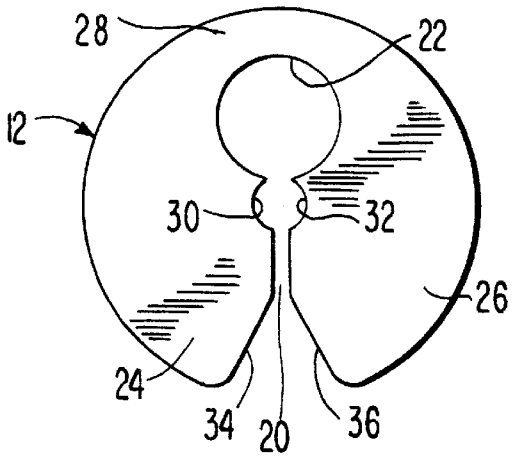
FIG. 10 is a top plan view of the pincer disk of the present invention.

Each of the arms 24 and 26 carries its own pincer surface 30,32. The pincer surfaces are opposite each other and are each arcuate in the preferred embodiment of the invention, in particular forming the section of a circle as best shown in FIG. 10. The shape and distance between surfaces 30,32 are selected to be slightly less than the diameter of the earring post, in the rest or unengaged position of the pincer disk which is shown in FIGS. 2 and 3. In this way, when disk 12 is pressed on to the post, arms 24,26 spread apart through the resiliency of bridge 28 and the surfaces 30,32 are biased into close engagement with the post to hold the disk on the post. The separation between pincer arms 24 and 26 continues along a straight slot 20 which is beyond surfaces 30,32, on an opposite side from opening 22, and a pair of inclined surfaces 34,36 which spread outwardly away from slot 20 and define a v-shaped opening into the slot. The outer circumference of disk 12 is generally circular and the disk is advantageously flat.

Figure 4:
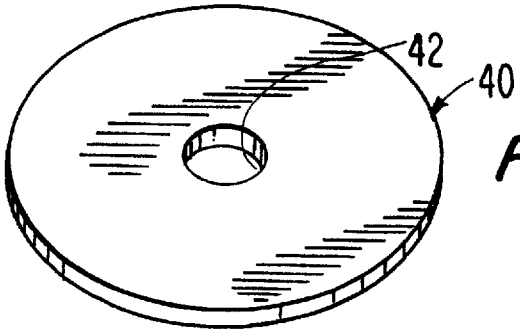
FIG. 4 is a perspective view of a washer which is used in the present invention.
Figure 8:
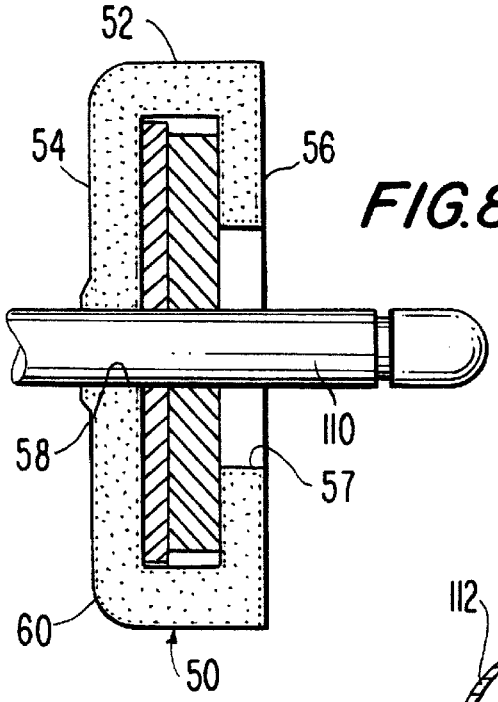
FIG. 8 is a sectional view, partly an elevation, of an earring post with clasp of the present invention in an engagement position.
Figure 9:
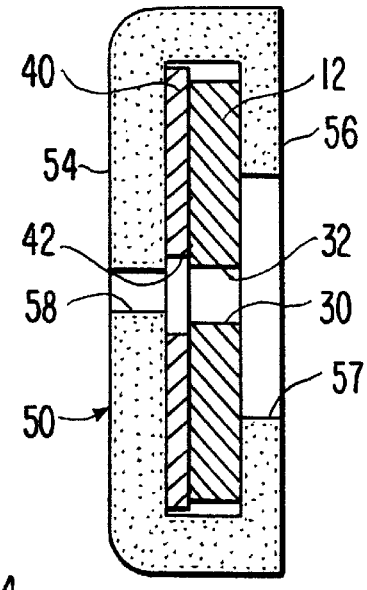
FIG. 9 is a sectional view of the clasp of a present invention in a rest or nonengagement position.
Figure 5:
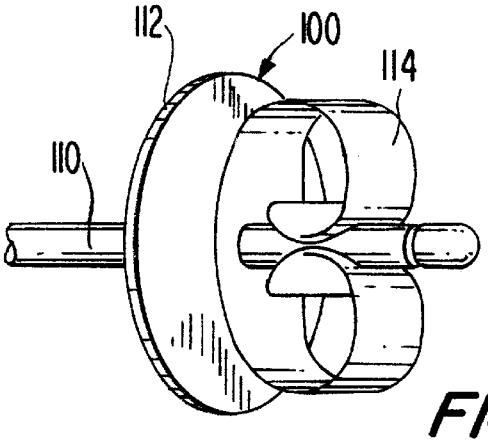
FIG.5 (PRIOR ART)
FIG. 5 is a perspective view of a prior art clasp shown on an earring post.
Figure 6:
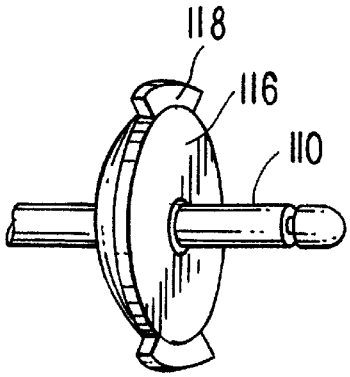
FIG.6 (PRIOR ART)
FIG. 6 is a view similar to FIG. 5 as another prior art clasp.
Figure 7:
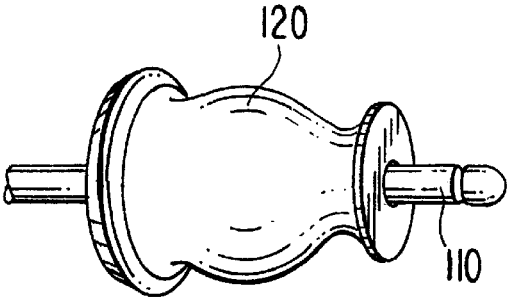
FIG.7 (PRIOR ART)
FIG. 7 is a view similar to FIG. 5 of a still further prior art clasp.
Figure 11:
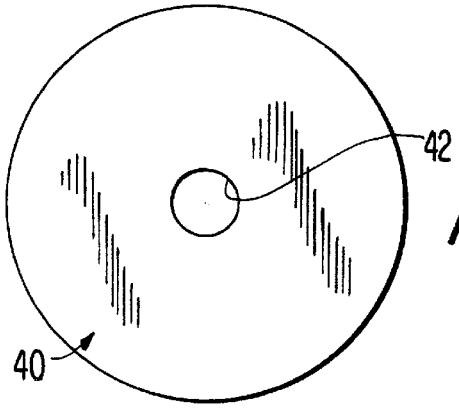
FIG. 11 is a top plan view of the washer of the present invention.
Figure 12:
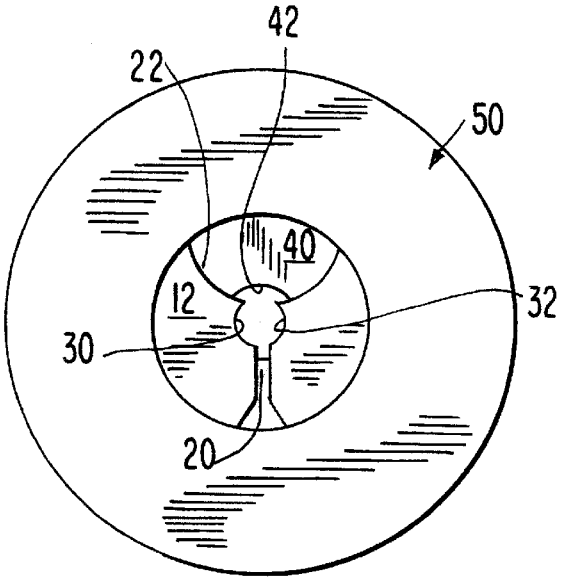
FIG. 12 is a top plan view of the clasp assembly according to the present invention.

In its simplest form, the invention can be achieved by using pincer disk 12 by itself although the disk is small and difficult to manipulate. The invention is improved by combining disk 12 with a washer 40 that is shown in FIGS. 4 and 11. Washer 40 is a flat circular plate of metal or other strong material having a central, preferably circular opening 42 which, when the disk and washer are held within the folder shown at 50 in FIG. 12, are aligned with each other. Opening 42 is larger than the diameter of the post and larger than the distance between the pincer surfaces 30,32, whether the pincer disk is in its rest position and or is in its engagement position. This relationship is better shown in FIG. 12. In this way, opening 42 in washer 40 helps direct the post into the space between pincer surfaces 30,32. Referring now to FIGS. 8 and 9, holder 50 has an outer cylindrical surface 52 with an earside circular surface 54 and an opposite outer surface 56. A circular hole 58, slightly smaller in diameter than post 110, is provided in holder 50 and extends through surface 54. This resiliently engages against the outer surface of earring post 110 and helps further hold the clasp on to the earring while at the same time protecting the back surface of the ear. To further protect the ear, the circular corner area between the cylindrical side wall 52 and the ear side surface 54, is gently curved as shown at 60.

The opposite surface 58 also contains an opening 57, but this one is much larger so that it provides an unobstructed passage for post 110. FIGS. 8 and 9 also show the relative thickness of disk 12 and washer 40, the disk being approximately twice the thickness of the washer and the washer being slightly larger in outer diameter.

To assemble the clasp of FIG. 9, washer 40 is first wedged into the holder through large opening 57 which expands due to the resiliency of the material of holder 50 to receive the washer. Next, the disk 40 is wedged into the opening 57 in the same way. In another method for assembling the invention, the washer and disk are stacked one above the other and then together pressed into the holder 50.

While a specific embodiment of the invention has been shown and described in detail to illustrate the application of the principles of the invention, it will be understood that the invention may be embodied otherwise without departing from such principles.

What is claimed is:

1. An earring post clasp for an earring post having a diameter, the clasp comprising:

a pincer disk made of resilient material and having an opening therein defining a pair of pincer arms that are connected to each other by a resilient bridge;

said arms each having a pincer surface adapted to engage the post so that the pincer surfaces of said arms are on opposite sides of the post when the disk is in an engagement position on the post;

said disk having a rest position when not engaged to a post, a space between said pincer surfaces in said rest position being less than the diameter of the post so that movement of said disk to said engagement position caused expansion of said opening and resilient bending of said bridge, resiliency of said bridge biasing said arms toward each other and biasing said pincer surfaces against the post;

a washer superimposed on the pincer disk; and an elastic holder having an opening therethrough and containing the clasp and disk.

2. A clasp according to claim 1 wherein the washer has a hole therethrough which is aligned with the pincer surfaces, the holder having opposite sides which both have holes therethrough aligned with the hole in the washer and with the pincer surfaces for together receiving the earring post.

3. A clasp according to claim 2 wherein the holder is cylindrical.

4. A clasp according to claim 3 wherein the holder has an earside surface and an opposite surface, the holder having a rounded corner around the perimeter of the earside surface.

5. A clasp according to claim 4 wherein the disk and the washer are both made of metal.

6. A clasp according to claim 5 wherein the disk is thicker and of less diameter than the washer.

7. An earring post clasp for an earring post having a diameter, the clasp comprising:

a pincer disk made of resilient material and having an opening therein defining a pair of pincer arms that are connected to each other by a resilient bridge;

said arms each having a pincer surface adapted to engage the post so that the pincer surfaces of said arms are on opposite sides of the post when the disk is in an engagement position on the post;

said disk having a rest position when not engaged to a post, a space between said pincer surfaces in said rest position being less than the diameter of the post so that movement of said disk to said engagement position caused expansion of said opening and resilient bending of said bridge, resiliency of said bridge biasing said arms toward each other and biasing said pincer surfaces against the post;

the opening being circular or oval and each of the pincer surfaces is an arc of a circle;

each arm having a straight edge adjacent a pincer surface defining a slot between said arms, and an outwardly inclined surface defining a v-shaped opening into said slot.

8. A clasp according to claim 7 including a washer in combination with the disk both held within an elastic holder.

9. A clasp according to claim 8 wherein the disk and washer are made of metal and the holder is made of elastic polymer material.

* * * * *